US008742945B2

(12) United States Patent
Brynielsson

(10) Patent No.: US 8,742,945 B2
(45) Date of Patent: Jun. 3, 2014

(54) METHOD FOR CONTROLLING TRAFFIC SIGNALS TO GIVE SIGNAL PRIORITY TO A VEHICLE

(75) Inventor: Thore Brynielsson, Kullavik (SE)

(73) Assignee: AB Tryggit, Västra Frölunda (SE)

( * ) Notice: Subject to any disclaimer, the term of this patent is extended or adjusted under 35 U.S.C. 154(b) by 869 days.

(21) Appl. No.: 12/450,426

(22) PCT Filed: Mar. 18, 2008

(86) PCT No.: PCT/SE2008/050306

§ 371 (c)(1),
(2), (4) Date: Oct. 14, 2009

(87) PCT Pub. No.: WO2008/118074

PCT Pub. Date: Oct. 2, 2008

(65) Prior Publication Data

US 2010/0045484 A1 Feb. 25, 2010

(30) Foreign Application Priority Data

Mar. 26, 2007 (SE) ..... 0700754

(51) Int. Cl.
*G08G 1/07* (2006.01)

(52) U.S. Cl.
USPC ..... 340/906; 701/515

(58) Field of Classification Search
USPC ..... 340/906, 907; 701/468, 515
See application file for complete search history.

(56) References Cited

U.S. PATENT DOCUMENTS

| | | | | |
|---|---|---|---|---|
| 4,573,049 | A | 2/1986 | Obeck | |
| 5,926,113 | A | 7/1999 | Jones et al. | |
| 6,700,504 | B1 | 3/2004 | Aslandogan et al. | |
| 6,909,380 | B2 | 6/2005 | Brooke | |
| 6,940,422 | B1 | 9/2005 | Bachelder et al. | |
| 7,113,108 | B1 | 9/2006 | Bachelder et al. | |
| 7,116,245 | B1 | 10/2006 | Bachelder | |
| 2003/0128135 | A1 * | 7/2003 | Poltorak | 340/906 |

FOREIGN PATENT DOCUMENTS

| | | |
|---|---|---|
| DE | 198 42 912 | 3/2000 |
| JP | 2000-259986 | 9/2000 |
| WO | WO 01/76105 | 10/2001 |
| WO | WO 2004/095391 | 11/2004 |
| WO | WO 2005/029437 | 3/2005 |

OTHER PUBLICATIONS

Supplementary European Search Report dated May 7, 2010 issued in corresponding European Application No. EP 08724253.3.
Rule 71(3) EPC Communication dated Aug. 4, 2011 issued in corresponding European Application No. EP 08724523.3.

* cited by examiner

*Primary Examiner* — Thomas Mullen
(74) *Attorney, Agent, or Firm* — Harness, Dickey & Pierce, P.L.C.

(57) ABSTRACT

A method for controlling traffic signals to give signal priority to a vehicle travelling along a planned route, which is divided into sections. The method comprises the steps of receiving a report from the vehicle which comprises at least the next few sections along the planned route, determining whether the reports contain at least one section on both sides of an intersection, and, if this is the case, controlling the traffic light at the intersection to give priority to the route through the intersection, for the vehicle to enjoy signal priority treatment. According to the invention, a signal priority method is provided which allows the planned route of the vehicle to be predicted well in advance. The possibility of advance planning is obtained by describing the planned route of the vehicle in terms of predefined sections of the route.

17 Claims, 3 Drawing Sheets

METHOD FOR CONTROLLING TRAFFIC SIGNALS TO GIVE SIGNAL PRIORITY TO A VEHICLE

FIELD OF THE INVENTION

The present invention relates to a method for controlling traffic signals to give signal priority to a vehicle travelling along a planned route, which is divided into a plurality of sections. The vehicle is equipped with a communication unit for regular communication of reports to a stationary system comprising at least one control unit, associated with an intersection, arranged to control at least one traffic light at the intersection.

BACKGROUND ART

Due to the large number of vehicles on our roads, intense local traffic flows occur now and then. The congestion is particularly noticeable in cities with many intersections, and traffic lights are often adapted to control traffic for optimising the traffic flow.

In some situations it may be appropriate to give priority to specific vehicles, such as emergency vehicles and local public transport. To give these specific vehicles the right of way when passing traffic lights, it is generally known to use signal priority systems. Traffic lights are controlled to give priority to the specific vehicles and to interrupt the normal signal operations. Effective signal priority operations include not only resetting the traffic lights concerned well in advance to allow the specific vehicle to pass, but also timing the operations to reduce disruption of normal traffic to a minimum.

Signal priority systems are disclosed, for example, in U.S. Pat. No. 6,940,422; U.S. Pat. No. 5,926,113; U.S. Pat. No. 6,909,380; and in WO2005/029467. The systems according to the above patents handle signal priority control in different ways, but with the same objective, namely to give the best possible signal priority treatment to one or more specific vehicles. Even if the systems provide increased accessibility for specific vehicles, more could be done in terms of improving the accuracy in identifying which traffic signals will be affected, when they will be affected and how their signals will be manipulated. In other words, there is a need for a solution offering improved advance planning and greater accuracy as to the planned route of the specific vehicle.

SUMMARY OF THE INVENTION

The object of the present invention is to remedy the above problems, and to provide a method for giving signal priority to specific vehicles, which method offers improved advance planning and greater accuracy as to the planned route of the specific vehicle.

This and other objects are achieved by a method for controlling traffic signals to give signal priority to a vehicle travelling along a planned route, which is divided into a plurality of sections. The vehicle is equipped with a communication unit for regular communication of reports to a stationary system comprising at least one control unit, associated with an intersection, arranged to control at least one traffic light at the intersection. The method comprises the steps of receiving, in said control unit, a report from the vehicle which comprises at least the next few sections along said planned route, determining whether the reports comprise at least one section on both sides of the intersection associated with the control unit, and, if this is the case, control said traffic light in said intersection to give priority to a route defined by said sections through the intersection, for said vehicle to enjoy signal priority treatment.

A signal priority method is thus obtained which makes it possible to predict the planned route of a vehicle well in advance. The possibility of advance planning is achieved by describing the planned route of the vehicle by means of predefined sections of said route. The road network has been divided beforehand in appropriate segments, i.e. sections, which may vary in length, one segment extending, for example, from one intersection to the next. The route along which the vehicle is travelling is then described in the form of these sections, which can be included in data messages where they take up very little memory. The messages are transmitted in the form of reports from the vehicle to the stationary system, i.e. to control units associated with intersections provided with traffic lights, a control unit being able to determine whether the report contains at least one section on both sides of the intersection associated with the control unit.

The ability of a control unit to determine whether it is affected by the planned route of the vehicle is achieved by each control unit knowing where in the road network it is located, i.e. it knows which of the traffic lights under its control that are located along which segments.

Whether a control unit receives the report being transmitted or not depends on its coverage area, which can be varied and adapted to specific needs and road network conditions. Conveniently, the coverage area of each control unit covers a plurality of blocks, thus allowing control units that control traffic lights along sections included in the report to be informed well in advance of the planned route of the approaching vehicle. By the control unit receiving information, via the report, about which section that follows after the intersection with which the control unit is associated, i.e. which section follows after the segment along which the traffic light under its control is located, the control unit will know the planned route of the vehicle after the intersection. Thus, the control unit is able to control the corresponding traffic light to interrupt its normal signal control operations in order to give priority, during an estimated period of time, to the route through the intersection that corresponds to the planned route of the vehicle.

Furthermore, the continuous transmission of reports from the vehicle contributes to continuously providing the control units with updated information. The communication of reports to the stationary system may, for instance, be based on the method and system disclosed in WO00176105.

The fact that the traffic lights of the present invention, owing to the control unit that controls them, "know" the planned route distinguishes it from, for example, U.S. Pat. No. 5,926,113 referred to above, in which the traffic lights have information on the position, speed and direction of the approaching vehicle, but know nothing else of the planned route. Likewise, the traffic lights described in previously mentioned WO2005/029437 know nothing about the planned route of the vehicle; instead, the probable route of the vehicle is predicted based on predetermined criteria and statistical data. To sum up, there is no method for predicting the planned route of the vehicle through a plurality of ensuing traffic lights corresponding to that of the present invention, which thus affords improved accessibility and greater accuracy as to the planned route of the vehicle over prior art.

The report may further include the vehicle's position. Moreover, the method for controlling traffic signals, based on the vehicle's position, may determine whether the vehicle is located within a relevant distance from the intersection, and only then carry out the step of controlling the traffic light.

By including also the vehicle's position in the reports being communicated from the vehicle to the stationary system, the accuracy in determining when the vehicle will reach an intersection can be optimised. According to one embodiment, for a particular intersection the criterion for activating the signal priority operation of a corresponding traffic light may be that a predetermined number of sections in the report are located upstream of the section along which the traffic light is located. Since each control unit is able to determine how the vehicle is approaching based on the updated contents of the report, the time of activation of the signal priority operation can be adjusted, if necessary, to occur neither too early nor too late. A late activation would mean that the signal priority operation is not implemented in time before the arrival of the vehicle, while an early activation would result in unnecessary disruption of the normal traffic flow. The regular communication of reports including updated information about the vehicle's position thus helps optimise the time of activation of the signal priority operation.

In addition to the fact that the control unit associated with the intersection which the vehicle is approaching knows that the vehicle is currently travelling the section along which the corresponding traffic light is located, the control unit is also able to determine, according to one embodiment, the distance remaining before the vehicle arrives. This allows the timing of the signal priority activation at the intersection to be optimised by making it independent of the number of sections that remain before the vehicle arrives and, thus, independent of the fact that the length of the sections vary. Instead of defining a specific number of sections remaining before the intersection as the criterion for activating the signal priority operations, the remaining distance of the vehicle to the intersection may be determining, which means that the time of activation will be independent of the length of each section.

A navigating system connected to the vehicle can be used to calculate the route, define which sections make up the route and guide the vehicle along the sections.

By connecting a navigating system to the vehicle, the vehicle is able to calculate, based on a final destination, an optimal route from the current position of the vehicle. According to one embodiment, the navigating system establishes the route in the form of sections made up of predefined segments in the road network, and the vehicle is then guided along the sections making up the route. The fact that the operations of calculating the route, determining which sections make up said route and guiding the vehicle to its final destination occur in a navigating system connected to the vehicle itself means that rapid recalculations are possible should the vehicle, for whatever reason, deviate from the planned route.

The flow of transmitted reports may be adapted to the section along which the vehicle is currently travelling.

The segments of the road network can be given different lengths depending on the road network conditions. For instance, the segments will be short in a city centre where traffic lights are close to one another and, advantageously, a segment is defined as the distance between two consecutive traffic lights. Correspondingly, it may be appropriate in rural areas, where traffic lights are not as frequent, to have relatively long segments. Because of the varying segment lengths, the need for a certain flow of reports being communicated from the vehicle to the stationary system will vary as the vehicle travels along the sections making up the route. In some cases, for instance in the city centre, it may be justified to have the continuous communication of reports be transmitted more frequently than what is necessary in a rural area. In this way, the flow of reports is adjusted to the current road network conditions, so that reports are not sent out too often nor too seldom.

The definition of the flow of reports for each segment may be based, for example, on the method disclosed in WO2004095391. WO2004095391 describes how to define, for each segment, a desired information flow from the vehicle, how to command the communication unit of the vehicle always to communicate with correctly adjusted accuracy and, thus, how to be able to effectively utilise the traffic information in the stationary system.

If the vehicle according to the embodiment should deviate, for whatever reason, from its planned route and, following a recalculation, a new route has to be communicated through reports as soon as possible, the denser flow used in the city centre, where most of the traffic lights are immediately affected, would contribute to a rapid transmission of updated reports. Thus, communicating with correctly adjusted accuracy for each segment will lead to the flow of continuously communicated reports to the stationary system being adapted to the current situation of each section along which the vehicle is travelling.

The contents of the report may be adapted to the section along which the vehicle is currently travelling.

As the vehicle moves along the route, finishing one section after the other, the remaining next sections along which the vehicle will be travelling are dealt with one by one. According to one embodiment, the finished section is not included in the upcoming report, which means that the contents of the reports will be updated as the vehicle finishes one section and enters the next. According to the embodiment, the signal priority operation at an intersection can be deactivated when the vehicle has left the section along which the corresponding traffic light is situated and an updated report has been communicated which no longer comprises said section. Thus, an updated report may deactivate the signal priority operation, following which the traffic lights return to normal signal operations with minimal disruption of the normal traffic flow.

The step of controlling the traffic lights according to the method may comprise directing existing traffic away from the priority route.

By a control unit knowing the planned route of the vehicle, not only is adequate signal priority given to the vehicle through the intersection associated with the control unit, but existing traffic along the route can be given the possibility of choosing roads that lead away from the route. For example, ordinary road-users may receive an indication of the planned route of the vehicle in the form of signs provided at intersections, on which signs flashing arrows indicate the planned direction of the vehicle in the corresponding intersection. This allows road-users travelling along the route to stay out of the way of the vehicle approaching from behind as much as possible and, if required, to turn off the route.

The step of controlling the traffic lights according to the method may further comprise preventing new traffic from entering the priority route.

If a control unit knows the planned route of the vehicle, this may also help prevent new traffic from entering the route. By giving a red light to traffic about to turn onto the planned route, an afflux of traffic is prevented, thereby improving accessibility for the priority vehicle.

The report may comprise only sections that correspond to a total limited distance. Alternatively, the report may comprise all the remaining sections along the planned route.

To reduce the number of traffic lights along the vehicle's route, which by their control units receiving reports are informed that the sections along which they are situated form part of the route, the upcoming sections included in the report may be limited to an aggregate total distance. Thus, according to the embodiment, only sections which when their lengths are added together fall below a fixed maximum distance are included in the report, the other sections following thereafter being ignored. A section that follows after the ones comprised in the report is included as a final section in the report only when the vehicle has finished one or more sections and the updated sum of sections, which includes said next section, falls below said maximum distance. In this way, the size of the reports can be limited, for instance, and the notifying of a control unit further ahead along the route of the fact that a segment comprising traffic lights controlled by the control unit constitutes a section can be postponed.

Alternatively, including the whole route in the report allows, according to another embodiment, for example the algorithms used to determine which sections are to be included in the report to be simplified.

BRIEF DESCRIPTION OF THE DRAWINGS

Particularly preferred embodiments of the present invention will now be described in greater detail for exemplifying purposes, reference being made to the accompanying drawings.

DESCRIPTION OF PREFERRED EMBODIMENTS

Figure 1:
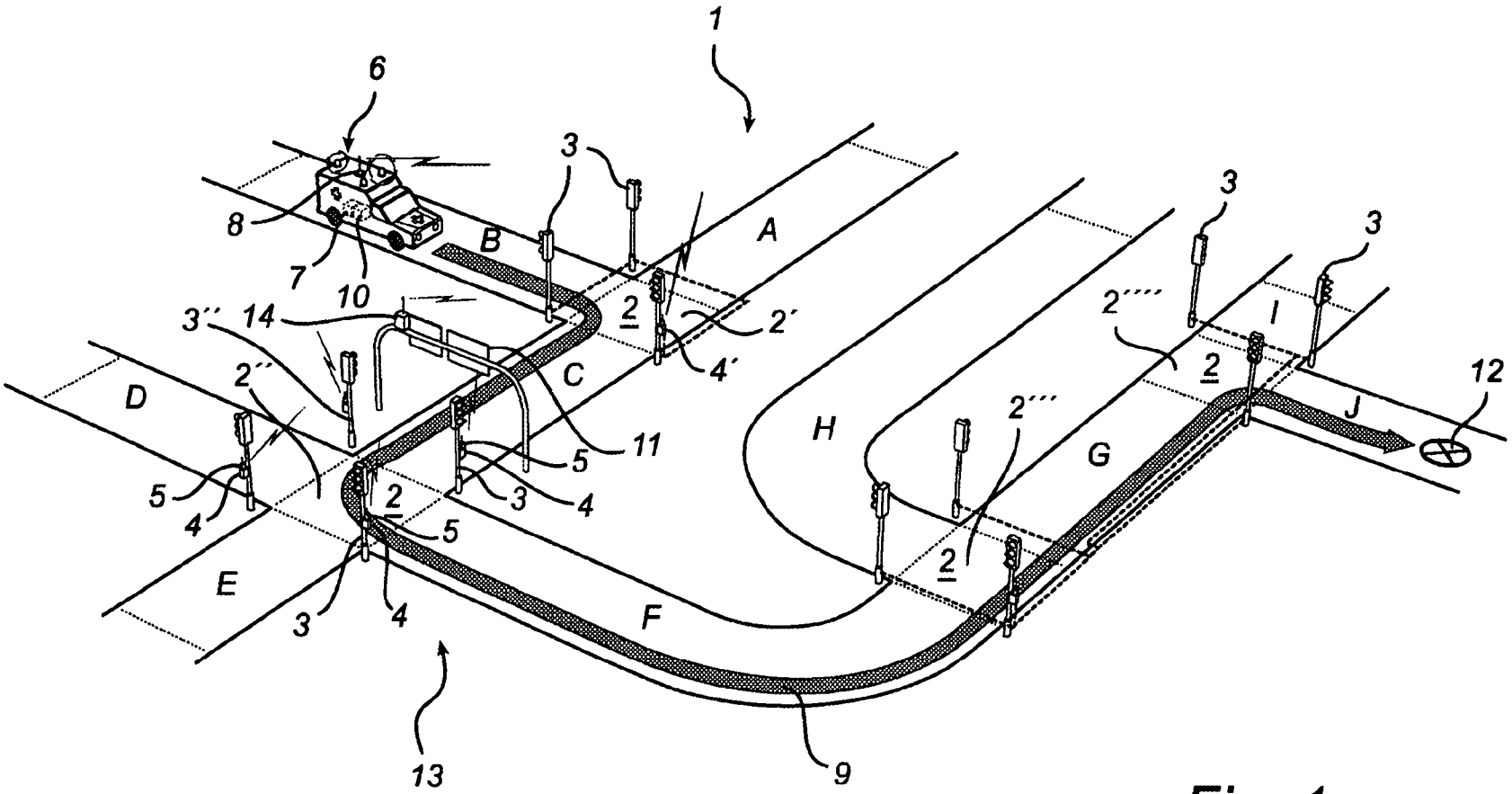
FIG. 1 is a general view of a road network divided into segments, which comprises intersections, a stationary system and a vehicle.

FIG. 1 outlines by way of example a road network 1 according to a preferred embodiment.

The road network 1 is divided into segments A-J, which when forming part of a route 9 are called sections. The road network 1 comprises intersections 2 provided with traffic lights 3, which are controlled by control units 4. As shown in FIG. 1, a single control unit 4' may control several traffic lights 3 at an intersection 2' or even traffic lights 3 of a plurality of intersections 2''', 2'''' in the form of networks, or alternatively each traffic light 3 may be equipped with its own control unit 4, as is the case for intersection 2''. Each control unit 4 is aware of its position in the road network 1, i.e. it knows which of the traffic lights 3 under its control that are located along which segments A-J. The traffic lights 3 and the control units 4 form part of a stationary system 13, which also comprises receivers 5. The receivers 5 are, for example, radio receivers, which are connected to the control units 4 for the purpose of communicating with a vehicle 6. Thus, the vehicle 6 is equipped with a communication unit 7 and an aerial 8, the aerial 8 being preferably a radio aerial.

To calculate a route 9, define the corresponding sections A-J and guide the vehicle 6 along the sections A-J, the vehicle 6 may, according to a preferred embodiment, be equipped with a navigating system 10.

The stationary system 13 may further comprise signs 11. These are preferably arranged at intersections 2 for indicating even more clearly to ordinary road-users that a signal priority operation is under way. Preferably, the signs 11 display flashing arrows that indicate the direction of the vehicle 6 through the associated intersection 2. This allows road-users travelling along the corresponding section A-J to stay out of the way of the vehicle 6 approaching from behind as far as possible and, if required, to turn off the route 9 or, alternatively, choose a lane that is not part of the route 9. The signs 11 are connected to control units 14 and receivers 5 similar to those of the traffic lights 3. The signs 11 may each be equipped with a control unit 14 or be collectively controlled or, alternatively, the signs 11 may be part of a network as described above, i.e. be controlled by a control unit 4 associated with a traffic light 3 or one or more intersections 2.

It is also preferred to provide flashing signals and sound signals at the intersections 2 for the purpose of attracting the attention of pedestrians (not shown), to make them aware of the approaching emergency vehicle 6.

Figure 2A:
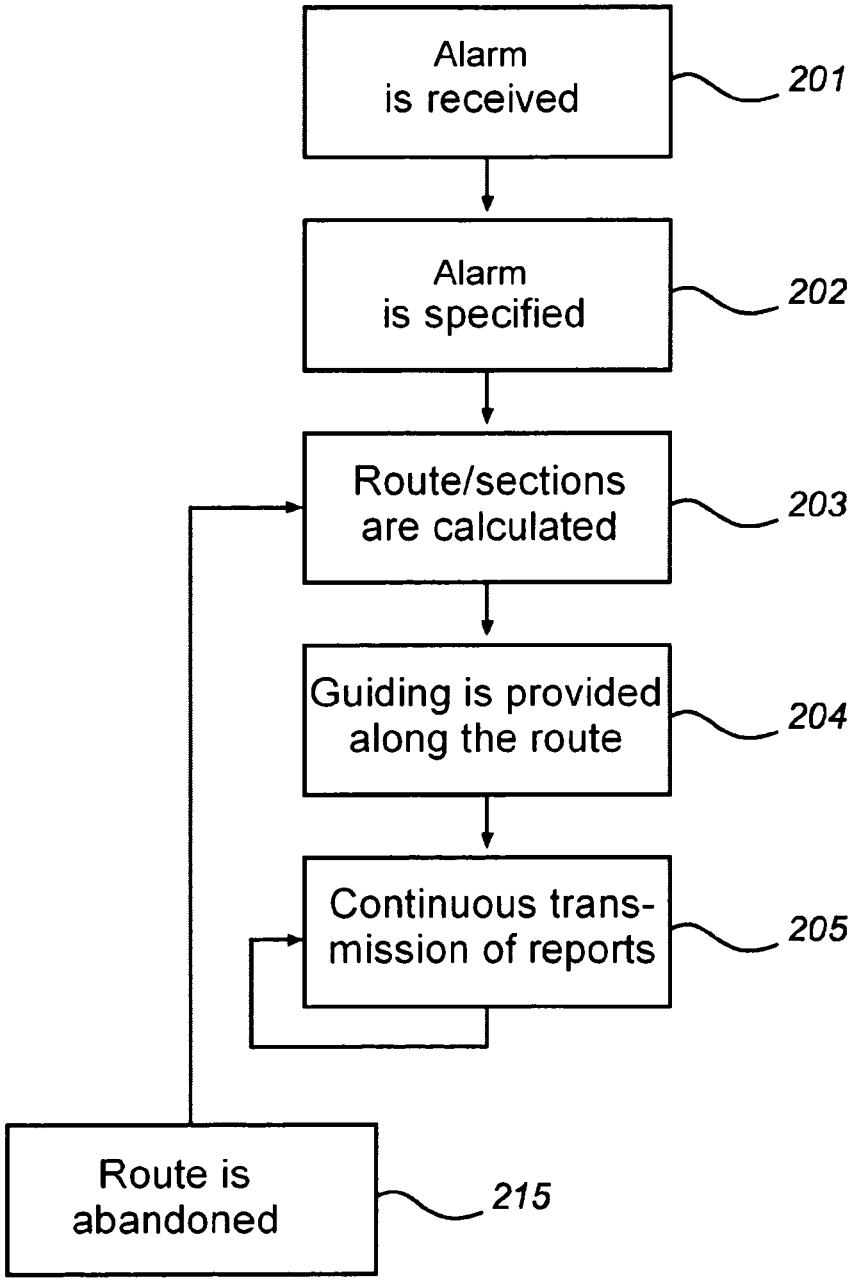
FIG. 2A is a flow chart of a signal priority method based on an emergency vehicle according to a preferred embodiment.
Figure 2B:
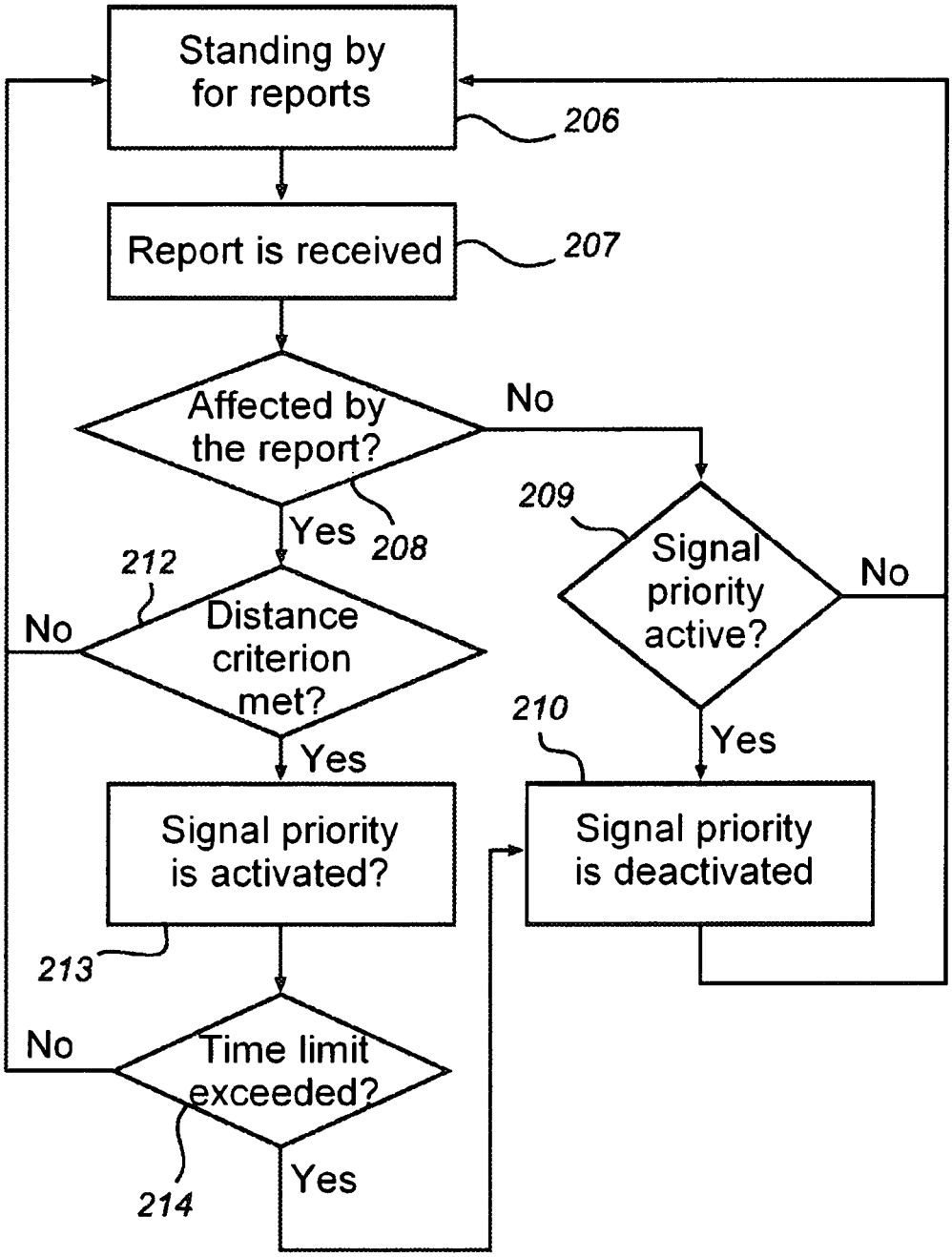
FIG. 2B is a flow chart of the signal priority method of FIG. 2A based on a control unit associated with an intersection, in accordance with a preferred embodiment.

FIGS. 2A and 2B are flow charts illustrating a signal priority method for an emergency vehicle 6 and a control unit, respectively, according to a preferred embodiment.

Based on FIG. 1 and FIGS. 2A and 2B, an exemplifying method will be described below for a supposed route 9 of the vehicle 6 through the road network 1, from the position of the vehicle 6 in segment B to the final destination 12. In the example, the vehicle 6 is an emergency vehicle and the final destination 12 is the scene of an accident.

The need to establish a route may, for example, be initiated by the driver of the vehicle 6, which in this case, as mentioned previously, is an emergency vehicle, being ordered, as indicated in step 201 of FIG. 2A, to go to the scene of an accident 12. The driver feeds the address 12 to the navigating system 10, as indicated in step 202, and then, in step 203, the most optimal route 9 is calculated and described in the form of those sections A-J that make it up. According to the example in FIG. 1, the route 9 is made up of sections B, C, F, G and J. Preferably, the route 9 is graphically displayed to the driver on a screen. The navigating system 10 then guides the driver along the route 9, as indicated in step 204, while at the same time reports containing the planned route 9 of the vehicle 6 are continuously being transmitted, in step 205, from the vehicle 6 to the stationary system 13.

As indicated in step 206 of FIG. 2B, the control units 4 are constantly ready to receive reports by means of their respective receivers 5.

How much of the stationary system 13 that receives the reports depend on each receiver's 5 coverage area, which can be varied. Preferably, each coverage area is adapted to the current road network situation of the corresponding part of the stationary system 13, which is why a rural area may be suited for large coverage areas, whereas a city centre where traffic lights 3 are close may be suited for smaller coverage areas. The purpose of a smaller coverage area may be, for instance, to avoid flooding large parts of the stationary system 13 with reports, and instead to limit the communication from the vehicle's 6 communication unit 7 to the immediate surroundings.

The flow of continuously transmitted reports may be varied. According to a preferred embodiment, the flow, i.e. the frequency with which the reports are transmitted, is adapted to the current road network conditions of each segment A-J. Accordingly, as it moves along the route 9 the vehicle 6 may, as illustrated in the example of FIG. 1, transmit reports at a specific flow rate in section A and at another flow rate in section E. The reason for this varying flow is, for instance, that it may be justified to send reports at shorter intervals in a city centre where traffic lights 3 are close to one another, for example every other second, and at longer intervals in a rural area where there are fewer traffic lights 3.

The actual contents of the report include at least the sections A-J that make up the route 9, and they are preferably lined up in the order in which the vehicle 15 passes them. Thus, sections A-J would, in the example of FIG. 1, be listed in the order B, C, F, G, J.

In addition to the sections A-J, the report preferably includes also the position of the vehicle 15. According to a preferred embodiment, the position is obtained from the navigating system 10, preferably via GPS.

It may also be advantageous to include a parameter in the report, for example in the form of one or a couple of digital numbers, which indicate the type of injury of the patient concerned. In the case of a patient with a back injury, it is important that the ride be as smooth as possible, while a patient with an acute heart condition needs the fastest possible transport. Accordingly, this allows the control units 4 to base their signal priority control on the current type of mission of the vehicle 6, which means, for example, that the timing of the activation of the signal priority operations can be adapted thereto.

Input of the parameter relating to the injuries of the patient of the ongoing mission is suitably made through input means (not shown).

According to one embodiment, the report contains all the sections A-J of the route 9, but according to an alternative embodiment the report may also be limited to containing only the upcoming sections, for instance B, C, F in the example of FIG. 1, based on the criterion that the total distance of sections B, C, F must not exceed a maximum distance, for example 1000m. Sections G, J further along the route 9, which cause the total distance of sections B, C, F, G, J to exceed the maximum value, are excluded from the report until the total distance when adding up is below the maximum distance.

As indicated in the exemplifying flow chart in FIG. 2B, after a report has been received in step 207, a control unit 4 checks, in step 208, whether the report contains a section A-J on both sides of the intersection 2 associated with the control unit 4. With reference to FIG. 1, this would mean in the case of intersection 2' that the control unit 4' compares the sections B, C, F, G, J included in the report with segments A, B and C, respectively. Should the control unit 4 find that it is associated with an intersection 2 with respect to which the report contains sections on both sides, which would be the case for sections B and C as shown in FIG. 1, the control unit 4 checks, according to a preferred embodiment as indicated in step 212, whether the vehicle 6 is located within a relevant distance from the intersection 2 associated with the control unit 4. The possibility of checking the distance is provided in the embodiment, according to which the vehicle's 6 position is included in the report, thereby allowing the control unit 4 to be informed about the remaining distance of the vehicle 6 before it reaches the associated intersection 2.

If it is established that the vehicle 4 is within a relevant distance from the control unit 4, the control unit 4 activates the signal priority operation in the associated intersection, as indicated in step 213, during a determined time period in accordance with the planned route 9 of the vehicle 6. In the example of FIG. 1, this would mean that when the vehicle 6 approaches the intersection 2" the control units 4 will control the respective traffic lights 3 of intersection 2" to give priority to the planned route 9 of the vehicle 6. Each control unit 4 activates the corresponding traffic light 3 when a report has been received that comprises sections (C, F) on both sides of the associated intersection 2", and when the criterion that the vehicle 6 is located within a relevant distance from the corresponding control unit 4 is met. Thus, during an estimated period of time, the traffic lights 3" will be controlled to give a green light from section C and onto section F.

In addition to the control unit 4 giving signal priority to the planned route 9 of the vehicle 6, the control unit 4 may also, according to a preferred embodiment, control the traffic lights 3 of the associated intersection 2 to give a red light to traffic about to enter the planned route 9. In this way, new traffic is prevented from pouring onto sections A-J and the vehicle's 6 accessibility along the planned route 9 is thereby improved. In the example of FIG. 1, this would mean that the traffic lights 3 along segments D and E, respectively, which run into intersection 2", are controlled to give a red light during their signal priority operations for route 9.

According to an alternative embodiment, the step 212 of checking the distance from the vehicle 6 to the current intersection 2 is not carried out, instead the control unit 4 activates its signal priority operations immediately, i.e. proceeds directly to step 213, when a report containing sections on both sides of an associated intersection 2 is received. Alternatively, the control unit 4 does not activate the signal priority operations immediately, but waits until the criterion that a maximum number of sections A-J remain before the vehicle 6 reaches the associated intersection 2 is met.

As indicated in step 214, a check is preferably carried out to verify whether the signal priority treatment has been active during a period of time that is shorter than a maximum limit. If the maximum signal priority time limit has been exceeded, the control unit 4 preferably resumes its ordinary signal control operations, as indicated in step 210. However, if the limit has not been exceeded, the control unit 4 returns to step 206 in which it stands by for an updated report indicating what the control unit 4 should do next. According to a preferred embodiment, a section A-J that the vehicle 6 has finished is not included in the next report, whereas an alternative may be that the finished section is included in the report, together with an indication that it has been finished. Preferably, a section is considered to have been finished when the navigating system 10 of the vehicle 6 has registered that the section has been finished and, thus, that the vehicle has left the intersection 2. This means that the contents of the report are updated once a section has been finished and that new instructions to the control units 4, if any, are transmitted. In the example of FIG. 1, the new instructions could be generated by the fact that the vehicle 6 has left the intersection 2" and, thus, section C. When the next report, which no longer includes section C, is received by the control units 4 associated with intersection 2", the control units 4 deactivate their respective traffic lights 3 and resume their ordinary signal control operations.

Let us return to step 208 and what happens when the report received by the control unit 4 does not contain sections A-J on both sides of the intersection 2 associated with the control unit 4. This may be the case if the control unit 4 is not affected in any way by the route 9, or alternatively if a section A-J which connects on an intersection 2 associated with the control unit 4 has been finished. Preferably, the control unit 4 then checks, as indicated in step 209, if signal priority is activated for the traffic lights 3 under its control. If this is so, the traffic lights 3 are instructed, as indicated in step 210, to deactivate signal priority and resume ordinary signal control operations. However, if no signal priority is active, the traffic lights 3 controlled by the control unit 4 maintain their ordinary signal control operations.

In both cases, the control unit 4 returns to stand-by mode to await, according to step 206, the next report.

Let us return to step 212 and what happens if the vehicle 6 is not located a relevant distance from an intersection 2, the associated control unit 4 of which has received a report containing sections on both sides of the intersection 2. The control unit 4 then returns to stand-by mode to await the next report, i.e. to step 206. Thus, signal priority is not activated if the control unit 4 receives a report in which the vehicle position indicated does not meet the criterion according to which the vehicle 6 should be located within a relevant distance from the associated intersection 2. In the example of FIG. 1, this could mean that a report which is received by the control unit 4 associated with intersections 2''' and 2'''' when the vehicle 6 is travelling along section B is ignored, whereas a report received when the vehicle 6 is travelling along section C activates the signal priority operations at intersection 2''' or alternatively at both intersections 2''' and 2''''.

Alternatively, in addition to waiting for a report according to which the vehicle position satisfies the distance criterion, the control unit 4 may activate the signal priority treatment based on a countdown algorithm. In this case, the control unit 4 activates the signal priority operations when the countdown algorithm, based on the position of the vehicle 6 according to the most recently received report(s), has estimated that the vehicle 6 should be within the relevant distance from the associated intersection 2. If an updated report that satisfies the distance criterion is received before countdown is terminated, which report causes the signal priority to be activated, the countdown is preferably discontinued since it no longer fulfils any purpose.

If, for whatever reason, the vehicle 6 deviates, as indicated in step 215 in FIG. 2B, from the planned route 9, this is recorded by the navigating system 10 and a new optimal route 9 is then calculated, according to step 203, based on the current position of the vehicle 6 and road network conditions.

When the vehicle 6 has reached its final destination, which in the example of FIG. 1 is the scene of the accident 12, the objective of the planned route 9 along which signal priority has been given to the vehicle 6 has been achieved and, preferably, the stationary system 13 continues to stand by for the next report, as indicated in step 206.

The invention claimed is:

1. A method for controlling traffic signals to give signal priority to a vehicle travelling along a planned route, which is divided into a plurality of sections, the vehicle being equipped with a communication unit for communication to a stationary system comprising at least one control unit associated with an intersection and arranged to control at least one traffic signal at said intersection, comprising:

receiving, in said control unit, a report from the communication unit of the vehicle, said report including information indicative of one or more sections of the plurality of sections along said planned route, determining whether said one or more sections include sections on different sides of the intersection associated with the control unit, and controlling, based on a result of the determining, said at least one traffic signal associated with said intersection to give signal priority to said vehicle traveling along the planned route.

2. A method according to claim 1, wherein said report further comprises information indicative of a position of the vehicle.

3. A method according to claim 2, further comprising determining, based on the position of the vehicle, whether the vehicle is located within a distance from said intersection, and then controlling said at least one traffic signal.

4. A method according to claim 1, wherein a navigating system coupled to the vehicle calculates the planned route, defines a subset of said plurality of sections included along said planned route, and generates information to guide the vehicle along said sections included along said planned route.

5. The method according to claim 4, wherein said subset of said plurality of sections does not include all of the plurality of sections along said planned route.

6. A method according to claim 1, wherein said communication to the stationary system, provided by said communication unit, is adapted to a current section of the plurality of sections along which the vehicle is currently travelling.

7. A method according to claim 1, wherein contents of the report received from the vehicle are adapted to a current section of the plurality of sections along which the vehicle is currently travelling.

8. A method according to claim 1, wherein controlling said at least one traffic signal comprises directing existing traffic away from the planned route.

9. A system according to claim 8, wherein the report comprises information indicating all remaining sections of the plurality of sections along the planned route.

10. A method according to claim 1, wherein controlling said at least one traffic signal comprises preventing new traffic from entering the planned route.

11. A method according to claim 1, wherein the report received from the vehicle only comprises sections of the plurality of sections that are included within a limited distance relative to the vehicle.

12. A method for managing traffic, comprising:

receiving information from a vehicle indicative of a plurality of sections along a planned route;

determining, based on the received information, whether a first section and a second section of the plurality of sections are located on different sides of an intersection; and controlling, based on a result of the determining, at least one traffic signal associated with said intersection to give signal priority to the vehicle over other traffic as the vehicle travels along said planned route.

13. The method according to claim 12, wherein the information is received directly from the vehicle through a wireless communication link.

14. The method according to claim 12, wherein the at least one traffic signal is located at the intersection.

15. The method according to claim 12, wherein controlling the at least one traffic signal is performed based on at least one condition.

16. The method according to claim 15, wherein the at least one condition corresponds to a distance between the vehicle and the intersection.

17. A traffic control system, comprising:

an interface to a traffic signal associated with an intersection; and a controller coupled to the interface and configured to receive a report corresponding to one or more sections along a planned route of a vehicle, the controller further configured to determine whether the report includes information indicative of at least two of the sections on different sides of the intersection, wherein:

if the report includes said information, the controller sends a signal through the interface to control the traffic signal to give signal priority to said vehicle travelling along said planned route.

* * * * *